US005770297A

United States Patent [19]

Grubich

[11] Patent Number: 5,770,297

[45] Date of Patent: Jun. 23, 1998

[54] GRIPPING DEVICE

[76] Inventor: Ivan J. Grubich, 3330 Longfellow Avenue, Windsor, Ontario, Canada, N9E 2L6

[21] Appl. No.: 725,348

[22] Filed: Oct. 1, 1996

[51] Int. Cl.[6] ..... B25B 13/50

[52] U.S. Cl. ..... 428/99; 428/156; 2/21; 2/163; 81/3.41; 81/3.43

[58] Field of Search ..... 428/99, 156; 2/20, 2/21, 163; 294/25; 81/3.41, 3.4, 3.42, 3.43

[56] References Cited

U.S. PATENT DOCUMENTS

| | | | |
|---|---|---|---|
| 1,464,529 | 8/1923 | Holcomb | 2/20 |
| 2,023,975 | 12/1935 | Qualey | 81/3.4 |
| 2,519,447 | 8/1950 | Ensminger | 81/3.4 |
| 2,554,410 | 5/1951 | Horton | 81/3.43 |
| 3,500,477 | 3/1970 | Meszaros | 2/161 |
| 4,090,419 | 5/1978 | Abraham | 81/3.4 |
| 4,754,499 | 7/1988 | Pirie | 2/20 |
| 4,805,238 | 2/1989 | Crafts | 2/20 |
| 4,894,866 | 1/1990 | Walker | 2/161 R |
| 5,309,793 | 5/1994 | Tipp | 81/3.43 |

FOREIGN PATENT DOCUMENTS

| | | | |
|---|---|---|---|
| 933057 | 8/1955 | Germany | 294/25 |
| 462585 | 3/1951 | Italy | 294/25 |

OTHER PUBLICATIONS

Locksley, Dec. 1965 Equipment Catalog, p. 17.

*Primary Examiner*—Alexander Thomas
*Attorney, Agent, or Firm*—Dickinson, Wright, Moon, Van Dusen & Freeman

[57] ABSTRACT

A gripping device comprises a thin strip of flexible material which is disposed between a user's index finger and thumb to facilitate gripping, particularly bottle cap removal. The flexible strip includes attachment bands which secure the strip to the thumb and index finger for use.

8 Claims, 1 Drawing Sheet

GRIPPING DEVICE

FIELD OF INVENTION

The present invention is directed to a gripping device and, in particular, to a bottle cap opening device which is compact, easy to wear and provides protection for a user's hand during cap opening.

BACKGROUND ART

Various types of container cap opening devices have been proposed in the prior art to facilitate removal of a given container cap. U.S. Pat. No. 4,754,499 to Pirie discloses a gripper pad or pads for hands including a pad covering the palm area of a hand and finger loops on the pad through which four fingers extend for securing the gripper pad to a user's hand.

U.S. Pat. No. 4,894,866 to Walker discloses a bartender's glove which includes an index finger portion and a thumb portion with truncated ends. The juncture between the index finger and the thumb has a leather grip affixed thereto which will frictionally grip a twist-off bottle cap. The glove has a wristband portion comprised of two flaps which are selectively fastenable, so as to make the wristband adjustable to various diameter wrists.

U.S. Pat. No. 4,805,238 to Crafts discloses a mitt which is designed to protect a mixologist from getting a callous in the palm of a hand opening a great many bottles of beer in a busy bar. The mitt consists of a flexible body with ventilation openings, and the palm portion engages with the palm of the user for protection of the user's palm. Forward straps are provided for receiving the forefinger and the little finger of the hand of the user and rear wrist straps are provided which include hook and loop pile fasteners for mitt attachment.

Many of the prior art designs discussed above are either cumbersome to use, difficult to put on, provide inadequate protection or have a short-lived life. For example, the gripper pad disclosed in Pirie patent does not fully cover the thumb portion or web between the thumb and the index finger when opening a container cap. Moreover, the gripper pad of Pirie makes it difficult to perform other tasks since it covers the entire palm.

Each of the grippers disclosed above are also cumbersome in that they require attachment portions to several fingers and/or the wrist. Moreover, the glove disclosed in Walker, although being adjustable at the wrist, may still not fit all users by virtue of its glove construction. The mitt disclosed in Crafts also fails to protect web between the index finger and thumb when opening container caps.

In view of the deficiencies in the prior art described above, a need has developed to provide a simple yet effective gripping device which has a one-size-fits-all configuration and does not interfere with other duties that a user may have to perform with one or more hands.

The present invention overcomes these prior art problems with a simple but effective gripping device that can facilitate cap removal without interfering with other actions of the user and is in a one-size-fits-all configuration.

SUMMARY OF THE INVENTION

Accordingly, it is a first object of the present invention to provide a novel container cap opening device.

Another object of the present invention is to provide a container cap opening device which is especially adapted to assist in removing bottle caps having serrated edges.

A further object of the present invention is to provide a container cap opening device which is adapted for use by any user and does not interfere with hand dexterity.

A still further object of the present invention is to provide a gripping device which is useful in gripping other implements.

Other objects and advantages of the present invention will become apparent as a description thereof proceeds.

In satisfaction of the foregoing objects and advantages, the present invention provides a gripping device which is especially adapted for opening container caps but also has utility in gripping other implements or devices. The inventive gripping device comprises a thin flexible strip of generally rectangular shape, the flexible strip having a gripping surface on one side and an opposing back surface. Also provided is a pair of attachment bands, each attachment band mounted to the thin flexible strip in a spaced-apart relationship and sized to receive a finger or thumb of a user. The flexible strip has a width approximating the width of a user's index finger or thumb and is sized in length to extend from a portion of a user's thumb, across the juncture between the user's thumb and a user's index finger and to extend along a portion of user's thumb.

The flexible strip and attaching bands can be made of a rubber, rubber-like material, fabric, laminate or other material which has sufficient friction for gripping. The gripping surface can also include areas of relief to improve gripping of a particular implement. The areas of relief can be integrally formed with the flexible strip or can be attached thereto in any known manner. The relief areas can be located on one or both of the gripping surface and back surface and arranged to cover the entire surface of the strip or be positioned only in select areas thereof. The device can also have indicia thereon for advertising purposes or the like.

BRIEF DESCRIPTION OF THE DRAWINGS

Reference is now made to the drawings of the invention wherein.

DESCRIPTION OF THE PREFERRED EMBODIMENTS

The inventive gripping device is particularly useful in opening twist-top containers such as beer bottles, pop bottles or the like. The device has particular use for a bartender who is often faced with opening these types of twist-top containers. Of course, the gripping device can also be used in other applications. For example, elderly people may use it for holding a pen or pencil or a drinking glass. Construction workers may find it useful in gripping tools such as hammers. Golfers could also find assistance in using the device as a substitute for a glove. Spot welders may also find the device useful, particularly when gripping the trigger of the welding gun.

Figure 1:
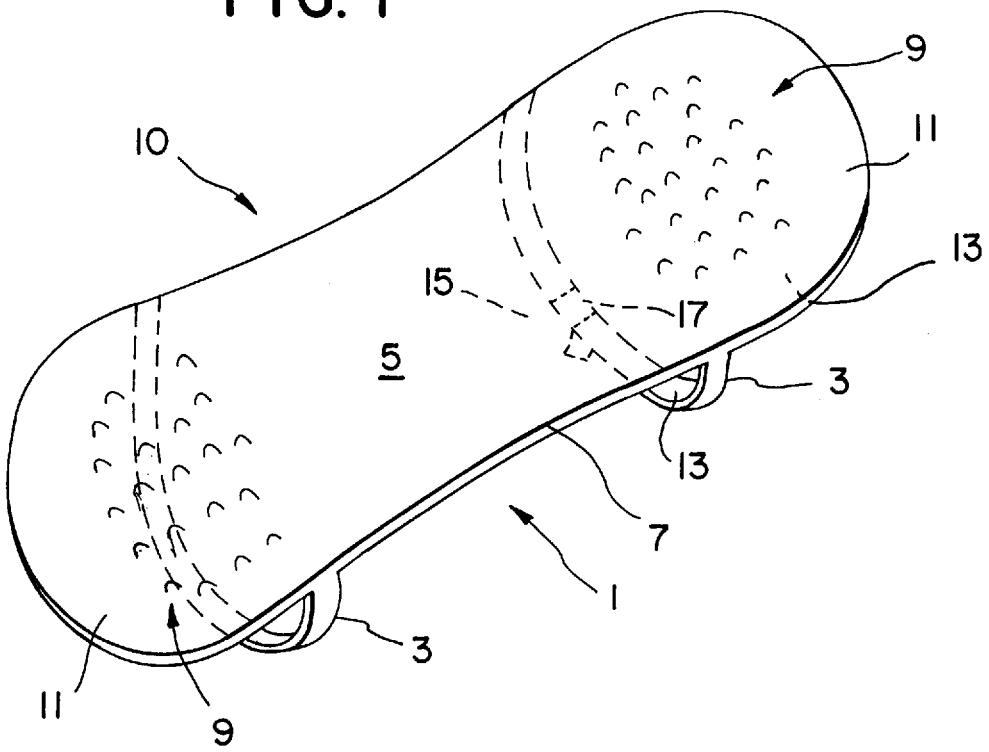
FIG. 1 is a perspective view of the inventive gripping device.

With reference now to FIG. 1, an exemplary embodiment of the gripping device is generally depicted by reference numeral 10 and is seen to include a thin flexible strip of material 1 which, as depicted in FIG. 1, has a generally rectangular shape. The flexible strip 1 includes a pair of attachment bands 3. The attachment bands are spaced apart and are secured to the flexible strip 1 at its peripheral edge 7.

Although the bands are shown integrally formed with the strip 1, they could be separate pieces of material which are attached in any conventional fashion such as adhesives, mechanical fasteners, threaded attachment or the like.

The flexible strip and/or attachment bands are preferably made of a friction material such as rubber or a rubber-like compound. Other materials which would provide sufficient gripping friction can also be used such as a leather-like material, a fabric or the like.

The attachment bands are also flexible or elastic to allow for a secure fit on a user's thumb and finger as will be described hereinbelow.

To assist gripping, the gripping surface 5 can have areas of relief 9 on opposing ends 11 of the flexible strip 1. The areas of relief can be integrally formed with the strip 1 or be in the form of an attached relief area which can be secured to the strip 1 by hook and pile fastening means, adhesives or the like.

The areas of relief 9 can generally cover the entire surface of the gripping surface 5 and, if desired, could also be placed on the back surface 13 of the strip 1. In this embodiment, since the bands 3 are flexible, the bands could be reversed so that they would be situated on the opposite side than that shown in FIG. 1 so that the surface 5 in FIG. 1 would be the back side and the surface 13 would be the front side.

In another alternative, each of the bands 3 could be formed in two parts with an adjustment clip to enlarge or diminish the opening 13 which receives a user's index finger or thumb. For illustration purposes, the twopiece band construction is identified by reference numeral 15. The coupling 17 can be any known type which would provide a friction or other type of attachment between the two bands for adjustment.

The length and width of the flexible strip are sized so that it provides protection for a user. That is, the width of the flexible strip 1 should be such that when an index finger is slipped through one opening 13 is and a thumb is slipped through another of the openings 13, the flexible strip 1 covers the area of the index finger and thumb and juncture therebetween which would normally come in contact with a container cap. This width would generally approximate the width of the index finger but can be made slightly larger if so desired.

The length of the flexible strip 1 should also be of sufficient length to extend along the index finger, the juncture between index finger and thumb and the thumb to provide adequate protection when opening a container cap. The flexible strip 1 should cover at least a portion of the index finger, the juncture and a portion of the thumb and could be sized to extend from the index finger tip all the way to the thumb tip, if desired.

Figure 2:
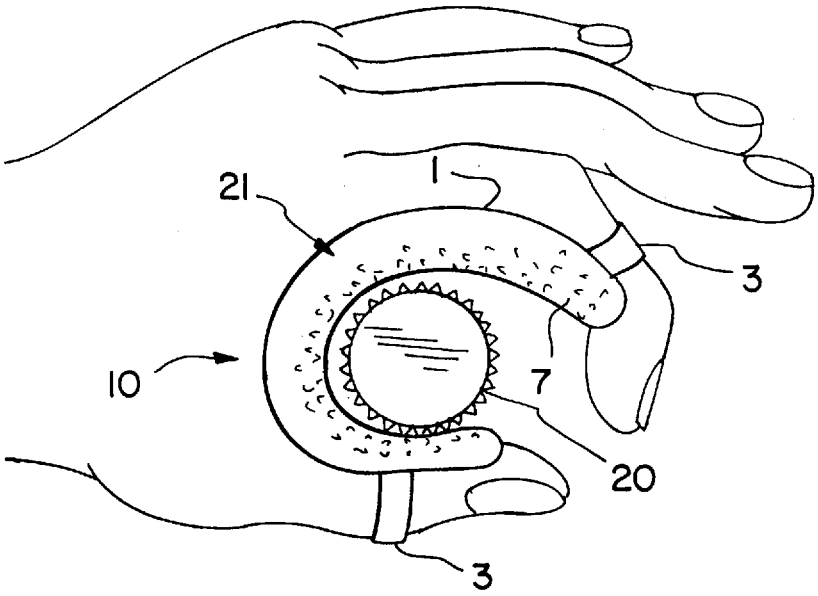
FIG. 2 shows the inventive device in an exemplary use.

Referring to FIG. 2, an exemplary use is depicted for the gripping device. Prior to use, the gripping device 10 is fitted onto a user's hand by slipping the index finger of a user through the opening 13 formed by one band 3 with the thumb being inserted in the opening 13 formed by the other band 3. Since the bands are elastic or flexible, they secure the strip 1 to the user. With the gripping device fit onto a user's hand, a user can grip a bottle cap 20 for easy removal and without injury or abrasion.

As shown in FIG. 2, the flexible strip 1 can also have indicia 21 thereon to either name the product or provide advertising for a bar or the like.

Although only one gripping device is depicted in FIG. 2, it should be understood that a bartender or other user could use a pair of gripping devices, each positioned on the hands of a user.

In yet a further embodiment, the flexible strip 1 could taper towards the middle so that the central portion of the strip 1 has a width less than the end portions 11. Moreover, to facilitate storage, the central portion of the strip 1 could also be creased so that the gripping device could be folded in half for easy storing. In addition, if desired, cut-out portions could be provided in various areas of the strip, these areas located so that the flexible strip still would prevent abrasion or other injury to a user's skin when the gripping device is used.

As such, an invention has been disclosed in terms of preferred embodiments thereof which would fulfill each and every one of the objects of the present invention as set forth hereinabove and provides a new and improved gripping device.

Of course, various changes, modifications, and alterations from the teachings of the present invention may be contemplated by those skilled in the art without departing from the intended spirit and scope thereof. Accordingly, it is intended that the present invention only be limited by the appended claims.

I claim:

1. A gripping device comprising:

a) a thin flexible strip of generally rectangular shape and having a gripping surface and an opposing back surface, the thin flexible strip defining a width approximating a width of a user's index finger or thumb and being made of an elastic material;

b) a pair of elastic attachment bands, each elastic attachment band integrally formed as part of the thin flexible strip and continuously extending between opposing edges of the thin flexible strip, each elastic attachment band mounted to the thin flexible strip in a spaced apart relationship and sized to form an opening with a portion of the opposing back surface, the opening formed by one elastic attachment band sized to receive only an index finger of a user, the opening formed by the other elastic attachment band sized to receive only a thumb of a user;

c) wherein the thin flexible strip is sized in length to extend along a portion of a user's thumb, along and adjacent the juncture between a user's thumb and a user's index finger and to a portion of a user's thumb, the width of the thin flexible strip being sized so that at least an inner surface of a middle finger, a ring finger and a little finger of a user are exposed so that the thin flexible strip does not interfere with manipulation or movement of the exposed fingers.

2. The gripping device of claim 1 wherein the gripping surface includes areas of relief to improve gripping of an implement.

3. The gripping device of claim 2 wherein the areas of relief are spaced apart on said gripping surface so as to generally face each other when the gripping device is attached to a user's fingers.

4. The gripping device of claim 1 wherein the thin flexible strip has a central area of a first width and opposing end portions of a second width greater than said first width.

5. The gripping device of claim 4 wherein said opposing end portions taper in width from said second width to said first width of said central portion.

6. The gripping device of claim 1 wherein one of said gripping surface and said opposing back surface have indicia thereon.

7. A method of gripping an article comprising the steps of:

a) providing a gripping device having:

i) a thin flexible strip of generally rectangular shape and having a gripping surface and an opposing back surface, the thin flexible strip defining a width approximating a width of a user's index finger or thumb and being made of an elastic material;

ii) a pair of elastic attachment bands, each elastic attachment band integrally formed as part of the thin flexible strip and continuously extending between opposing edges of the thin flexible strip, each elastic attachment band mounted to the thin flexible strip in a spaced apart relationship and sized to form first and second openings with a portion of the opposing back surface, the first opening formed by one elastic attachment band sized to receive only an index finger of a user, the second opening formed by the other elastic attachment band sized to receive only a thumb of a user, wherein the thin flexible strip is sized in length to extend along a portion of a user's thumb, along and adjacent the juncture between a user's thumb and a user's index finger and to a portion of a user's thumb, the width of the thin flexible strip being sized so that at least an inner surface of a middle finger, a ring finger and a little finger of a user are exposed so that the thin flexible strip does not interfere with manipulation or movement of the exposed fingers;

b) inserting only a thumb into the first opening and only an index finger in the second opening by stretching of each of the elastic bands;

c) positioning an article in the juncture between the user's thumb and the user's index finger so that the article contacts the gripping surface of the thin flexible strip and exposing at least an inner surface of a middle finger, a ring finger and a little finger of a user by reason of said width of the thin flexible strip for manipulation of the exposed fingers; and d) grasping the article with the gripping surface by movement of the user's index finger and thumb so that the gripping surface and juncture between the index finger and thumb press against the article.

8. The method of claim 7, further comprising the steps of providing a bottle cap as the article and, after said grasping step, twisting the bottle cap with the gripping surface to open the bottle.

* * * * *